US012221750B2

(12) United States Patent
Buerger et al.

(10) Patent No.: US 12,221,750 B2
(45) Date of Patent: Feb. 11, 2025

(54) TAMPING TINE AND METHOD FOR TAMPING A TRACK

(71) Applicant: Plasser & Theurer Export von Bahnbaumaschinen Gesellschaft m.b.H., Vienna (AT)

(72) Inventors: Martin Buerger, Linz (AT); Gerald Zauner, Wilhering (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 797 days.

(21) Appl. No.: 17/440,545

(22) PCT Filed: Mar. 11, 2020

(86) PCT No.: PCT/EP2020/056414
§ 371 (c)(1),
(2) Date: Sep. 17, 2021

(87) PCT Pub. No.: WO2020/207686
PCT Pub. Date: Oct. 15, 2020

(65) Prior Publication Data

US 2022/0145548 A1 May 12, 2022

(30) Foreign Application Priority Data

Apr. 11, 2019 (AT) ..... A 130/2019

(51) Int. Cl.
*E01B 27/16* (2006.01)
*E01B 27/12* (2006.01)

(52) U.S. Cl.
CPC ..... *E01B 27/16* (2013.01); *E01B 27/12* (2013.01); *E01B 2203/12* (2013.01)

(58) Field of Classification Search
CPC ..... E01B 27/00; E01B 27/12; E01B 27/13; E01B 27/16; E01B 2203/12
(Continued)

(56) References Cited

U.S. PATENT DOCUMENTS 10,011,975 B2 7/2018 Carpenter et al.
10,900,197 B2 1/2021 Futakami
(Continued)

FOREIGN PATENT DOCUMENTS

CA 3060208 A1 * 12/2018 ..... E01B 27/16
CN 102031734 A 4/2011
(Continued)

OTHER PUBLICATIONS

International Search Report of PCT/EP2020/056414, mailed Apr. 22, 2020 with English translation.
(Continued)

*Primary Examiner* — Zachary L Kuhfuss
*Assistant Examiner* — Heaven R Buffington
(74) *Attorney, Agent, or Firm* — Collard & Roe, P.C.

(57) ABSTRACT

The invention relates to a tamping tine for a tamping machine for tamping a track, including a tine shaft which has at its upper end a retaining portion for fastening in a tine mount and which merges at its lower end into a tine plate. In this, a sensitive element of a sensor is arranged in a recess of the tine shaft, and the tamping tine includes a coupling element for transmission of a sensor signal. In this manner, the tamping tine fulfils a sensor function for recording measuring values occurring in the tamping tine.

15 Claims, 2 Drawing Sheets

(58) Field of Classification Search
USPC ..... 104/10
See application file for complete search history.

(56) References Cited

U.S. PATENT DOCUMENTS

| | | | | |
|---|---|---|---|---|
| 10,914,040 | B2 | 2/2021 | Hofstaetter et al. | |
| 2006/0022063 | A1* | 2/2006 | Tsai | E01B 26/00 238/8 |
| 2017/0268180 | A1* | 9/2017 | Lichtberger | E01B 35/08 |
| 2017/0305393 | A1* | 10/2017 | Michelsen | B60S 3/006 |
| 2018/0154914 | A1* | 6/2018 | Carmona | B61L 23/047 |
| 2020/0181850 | A1 | 6/2020 | Kopf et al. | |

FOREIGN PATENT DOCUMENTS

| | | | | |
|---|---|---|---|---|
| EP | 1808531 | A1 * | 7/2007 | B61L 1/02 |
| JP | 51149605 | A1 * | 12/1976 | |
| JP | S51149605 | A | 12/1976 | |
| JP | 2002146702 | A | 5/2002 | |
| JP | 2003139508 | A | 5/2003 | |
| JP | 2018505331 | A | 2/2018 | |
| SU | 1194940 | A1 | 11/1985 | |
| WO | 2011/003427 | A1 | 1/2011 | |
| WO | 2017/097390 | A1 | 6/2017 | |
| WO | 2017/129215 | A1 | 8/2017 | |
| WO | 2017/183404 | A1 | 10/2017 | |
| WO | 2018/219570 | A1 | 12/2018 | |

OTHER PUBLICATIONS

Austrian Search Report in Austrian Application No. A 130/2019 dated Jan. 30, 2020.
Chinese Office Action in Chinese Application No. 202080025532.4 dated Mar. 16, 2023.
Indian Examination Report in Indian Application No. 202127036755 dated May 3, 2023.

* cited by examiner

TAMPING TINE AND METHOD FOR TAMPING A TRACK

CROSS REFERENCE TO RELATED APPLICATIONS

This application is the National Stage of PCT/EP2020/056414 filed on Mar. 11, 2020, which claims priority under 35 U.S.C. § 119 of Austrian Application No. A 130/2019, filed on Apr. 11, 2019, the disclosure of which is incorporated by reference. The international application under PCT article 21(2) was not published in English.

FIELD OF TECHNOLOGY

The invention relates to a tamping tine for a tamping machine for tamping a track, including a tine shaft which has at its upper end a retaining portion for fastening in a tine mount and merges at its lower end into a tine plate. The invention additionally relates to a tamping machine for tamping a track, wherein oppositely positioned tamping tools are supported—actuatable with a vibration and squeezable towards one another—on a vertically adjustable tool carrier. The invention further relates to a method for operating the tamping machine having tamping tines.

PRIOR ART

WO 2011/003427 A1, for example, discloses a tamping tine for a tamping machine for tamping a track. The tamping machine here comprises tamping tools with tine mounts for clamping a respective tamping tine.

According to WO 2018/219570 A1, a method for compacting a track ballast bed by means of a tamping machine is known. In this, force measuring sensors are arranged at tine mounts of a tamping unit in order to record during a vibration cycle a progression of a force, acting on the tamping tool, over a distance covered by the tamping tool. Alternatively, strain gauges may be glued to an exterior surface of the respective tamping tine. Insufficient durability and the complicated and expensive application are disadvantageous here.

DESCRIPTION OF THE INVENTION

It is the object of the invention to show a tamping tine of the type mentioned at the beginning with which an improved tamping operation can be carried out. A further object of the invention is to show a tamping machine for an improved execution of a tamping operation. In addition, a correspondingly improved method for operating the tamping machine is to be shown.

According to the invention, these objects are achieved by way of the features of independent claim 1. Dependent claims indicate advantageous embodiments of the invention.

In this, a sensitive element of a sensor is arranged in a recess of the tine shaft, and the tamping tine includes a coupling element for transmission of a sensor signal. In this manner, the tamping tine itself fulfils a sensor function for recording a measuring value occurring in the tamping tine. Here, an optimal arrangement of the sensitive element exists because the recess in the tine shaft is matched to the characteristics of the sensor. The desired measuring values can be recorded with high precision, wherein the integration of the sensitive element into the tine shaft prevents any influence by disturbance factors. In addition, the arrangement protects the sensitive element from being damaged.

In an advantageous further development, the tamping tine includes electronics of the sensor. With this, for example, a calibration of the sensor or of the sensitive element can be carried out prior to delivery of the tamping tine, wherein calibration data can be stored in the electronics. Advantageously, the electronics include a memory chip, the connector of which is guided to the outside via a cable.

A further improvement provides that the sensitive element is designed for recording several measuring values occurring in the tamping tine. For example, the temperature of the tamping tine is recorded in addition to a mechanical stress. In this way, the sensor is suited for the monitoring of operating conditions during a tamping procedure in order to derive from this any maintenance requirements.

For simple exchange of a tamping tine, it is advantageous if the coupling element is an element of a detachable plug connection. When changing tamping tines, the plug connection is released and the tamping tine is replaced by a new tamping tine. The new tamping tine has the same plug connector in order to restore the plug connection.

For ensuring compatibility, the tamping tine usefully includes an electronic component for marking the tamping tine. Favourably, this is a so-called Trusted Platform Module which prevents any manipulation of the marking.

In an advantageous embodiment of the tamping tine, the sensitive element is a strain element glued into the recess. In this manner, forces and accelerations acting on the tamping tine can be recorded easily.

A further improvement provides that the sensitive element is a fibre optic cable with a fibre Bragg grating. Using such a fibre Bragg grating, extensions, compressions and bendings can be measured at a predefined point of the fibre optic cable. From this, forces, accelerations and temperature changes can be derived.

It is favourable if the fibre optic cable protrudes from the recess of the tine shaft, and that the protruding portion of the fibre optic cable is sheathed by a flexible protective cover. In this manner, the fibre optic cable with the protective sheath is guided up to a location at which evaluation electronics are arranged.

Advantageously, the recess is formed as a longitudinal bore in a core section of the tine shaft. Thus, the sensitive sensor element is optimally protected from damage without negatively influencing the strength of the tine shaft. Optionally, a mechanical kink protection is arranged at an exit point.

In the tamping machine according to the invention for tamping a track, oppositely positioned tamping tools are supported—actuatable with a vibration and squeezable towards one another—on a vertically adjustable tool carrier, wherein the respective tamping tool includes a tine mount in which an above-described tamping tine is fastened, and wherein an evaluation device is coupled to the sensor of the respective tamping tine. With this, measuring values occurring in the tamping tines during a tamping operation can be recorded to thus optimize the tamping operation.

In this, it is advantageous if the evaluation device is connected by means of a plug connection to the respective sensor, and if the respective plug connection is arranged in particular at the tool carrier. This simplifies the exchange of a tamping tine without impeding the recording of measuring values.

The method according to the invention for operating the above-described tamping machine having the described tamping tines envisages that a measuring value occurring in the respective tamping tine is recorded during a tamping operation by means of the associated sensor and registered by means of the evaluation device. Thus, the measuring values recorded during a tamping procedure can be used for optimizing subsequent tamping procedures. Additionally, the tamping quality and the occurring stresses can be documented.

In an improved method, a calibration procedure is carried out for each sensor prior to a tamping operation in order to determine calibration values. This recurring renewal of the calibration values ensures that each sensor functions with utmost precision at all times.

A further improvement of the method provides that, prior to a tamping operation, a readout process is started for each tamping tine, and that—in the case of a missing or wrong electronic component for marking the respective tamping tine—the tamping operation is blocked. This prevents the tamping machine from being operated with wrong tamping tines. Using the wrong tamping tines can lead to quality losses during tamping or to high wear. In addition, wrong tamping tines cannot be used for recording measuring values according to the invention.

In order to be able to query the current status of the tamping machine at any time, it is favourable if an exchange of a tamping tine is registered by means of the evaluation device. Corresponding status data can also be transmitted to a cloud to document each exchanging procedure.

BRIEF DESCRIPTION OF THE DRAWINGS

The invention will be described below by way of example with reference to the accompanying drawings. There is shown in a schematic manner in.

DESCRIPTION OF THE EMBODIMENTS

Figure 1:
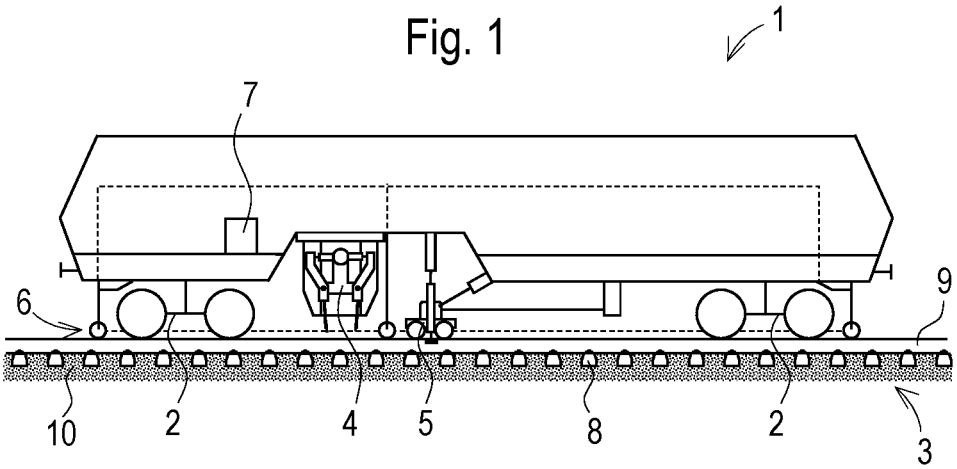
FIG. 1 a tamping machine

The tamping machine 1 shown in FIG. 1 is mobile by means of on-track undercarriages 2 on a track 3 to be tamped and comprises a tamping unit 4, a lifting-/lining unit 5, a measuring system 6 and a machine control 7. The track 3 is a ballast track in which a track grid formed of sleepers 8 and rails 9 is supported in a ballast bed 10. During a tamping operation, the track grid is lifted to a target position and optionally shifted laterally by means of the lifting-/lining unit 5. A comparison of the current position of the track grid to the target position takes place by means of the measuring system 6.

The target position is fixed in that the tamping unit 4 with vibrating tamping tool tines 11 penetrates into the ballast bed 10 between the sleepers 8 and compacts ballast under the sleepers 8 by way of a squeezing motion. Controlling the lifting-/lining unit 5 and the tamping unit 4 takes place by means of the machine control 7 while utilizing the measuring system 6.

Each tamping tine 11 is fastened in a tine mount 12 of a tamping tool 13. To that end, a tine shaft 14 of the respective tamping tine 11 has at its upper end a retaining portion 15 which is stuck into the tine mount 12. The retaining portion 15 is designed cylindrically, for example, and provides a fit with a cylindrical inner surface of the tine mount 12. The retaining portion 15 is wedged into the tine mount 12 by means of screws. At its lower end, the tine shaft 14 merges into a tine plate 16.

Oppositely positioned tamping tools 13 are supported in a tong-like manner on a common tool carrier 17. The tool carrier 17 is guided for vertical adjustment in an assembly frame 18. Upper ends of the tamping tools 13 are connected via respective squeezing drives 19 to a vibration generator 20. The squeezing drives 19 are supported, for example, on a rotating eccentric shaft. In an alternative design, the vibration generation is integrated in the respective squeezing drive 19. In this, cyclic vibration strokes are superimposed on a squeezing stroke in a hydraulic cylinder.

Figure 2:
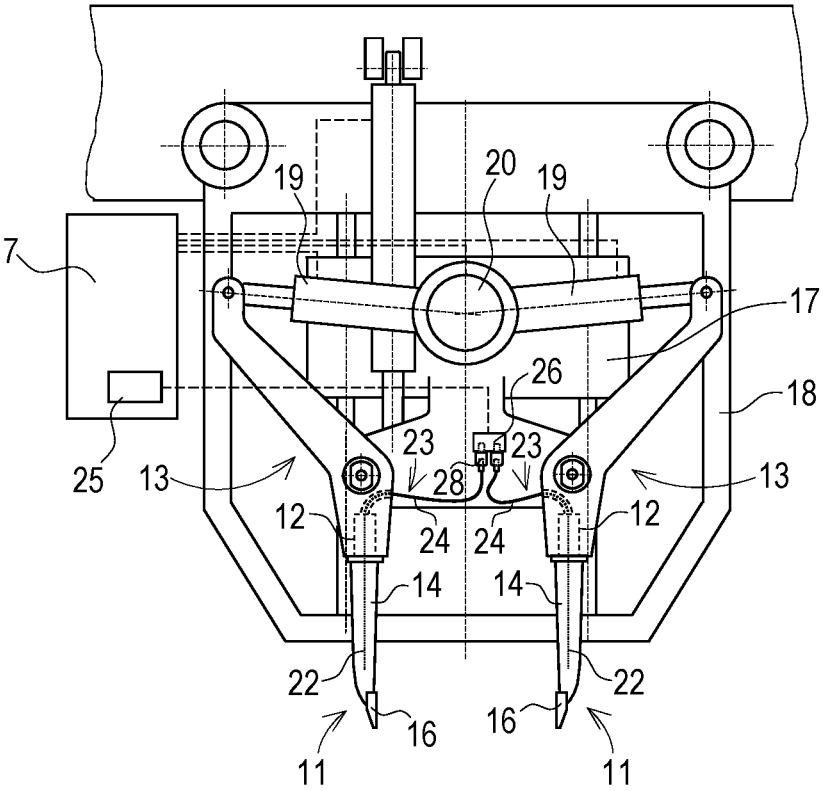
FIG. 2 a tamping unit

In order to monitor and, optionally, influence the quality of a tamping procedure, at least one measuring value occurring in a tamping tine 11 is recorded. For that purpose, a sensitive element 22 of a sensor 23 is arranged in a recess 21 of the tine shaft 14. The measuring value is fed to an evaluation device 25 via a coupling element 24 connected to the sensitive element 22. In the variant shown in FIG. 2, the evaluation device 25 is connected to the respective sensor 23 by means of a plug connection 26. The evaluation device 25 is set up in the machine control 7, for example.

Advantageously, the sensitive element 22 is a fibre optic cable with a fibre Bragg grating. In this, the portion having the fibre Bragg grating is glued into the recess 21 of the tine shaft 14. In this manner, the extensions, compressions or bendings in the tine shaft 14 are transmitted to the fibre optic cable. The fibre optic cable is guided out of the tine shaft 14 at a recess opening 27. Advantageously, a mechanical protection is arranged here to avoid damage to the fibre optic cable. In the example according to claim 2, the protruding section of the fibre optic cable with the connection to sensor electronics 28 forms the coupling element 24. This section is sheathed by a flexible protective covering (an armoured hose, for example).

In further sequence, the extensions, compressions and bendings of the tine shaft 14 recorded by means of the fibre optic sensor 23 are analysed. For example, forces, accelerations and temperature changes are determined from this in the evaluation device 25 by way of calculation. Further measuring values can be derived from the measuring signals by means of the sensor electronics 28 also. Basis for this is a preceding calibration process.

The calibration of the sensor 23 takes place, for example, by the manufacturer prior to delivery. During this, the calibration data are stored in the sensor 23 or in a separate memory element. Advantageously, a memory chip 29 is glued into the tamping tine 11, the connector of which is guided to the outside via a cable. In an alternative wireless sensor 23, the readout of the memory chip data takes place by means of a reader which can be designed stationary or mobile. The data are transmitted to the machine control 7 via a radio interface.

Alternatively or additionally to the initial calibration, an automatic calibration program is carried out prior to each machine employment. In this, calibration values are determined for each tamping tine. The updated values are stored in the memory chip 29.

Usefully, the tamping tine 11 comprises a further electronic component 30 which enables an electronic marking of the tamping tine 11. For example, a so-called Trusted Platform Module is implemented which ensures a forgery-proof identification of the tamping tine 11. Favourably, the memory chip 29 and the electronic component 30 are integrated into the sensor electronics 28.

In this, the machine control 7 is set up in such a way that a readout process is started after putting the machine 1 into action and prior to carrying out a first tamping operation. If the respective electronic component 30 is missing, or if an identification of the respective tamping tine 11 is not possible, then the tamping operation is blocked. Thus it is prevented that a tamping operation is executed with the wrong tamping tines. The readout process can also be used for documenting a tamping tine exchange.

Figure 3:
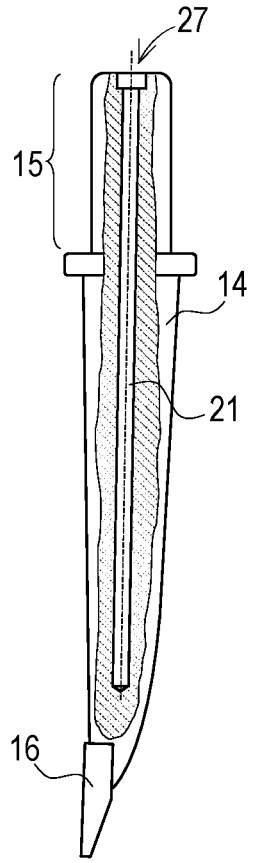
FIG. 3 a tamping tine with longitudinal bore

In FIG. 3, the recess 21 is shown as a longitudinal bore in a core region of the tine shaft 14. This does not weaken the tine shaft 14 since the geometrical moment of inertia of the shaft cross-section is influenced only slightly. The longitudinal bore extends approximately up to the tine plate 16. Thus, counterforces of the ballast bed 10 acting on the tine plate 16 can be immediately detected with a fibre Bragg grating at the end of a fibre optic cable glued in. In a simpler variant, the recess 21 is designed as a groove along the tine shaft 14, wherein the groove is sealed after installing the sensitive element 22.

Figure 4:
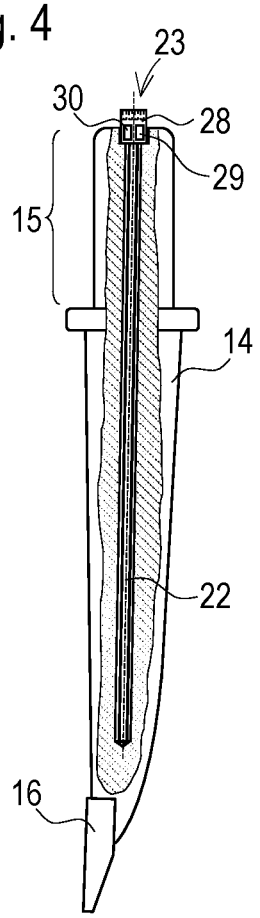
FIG. 4 a tamping tine with a sensitive element and coupling element

In the region of the recess opening 27, a countersinking for the sensor electronics 28 is provided. In this, the memory chip 29 and the electronic component 30 as well as plug contacts 31 are also accommodated in a glued-in electronics enclosure (FIG. 4). In this variant of embodiment, the tamping tine 11 contains the entire sensor 23.

Figure 5:
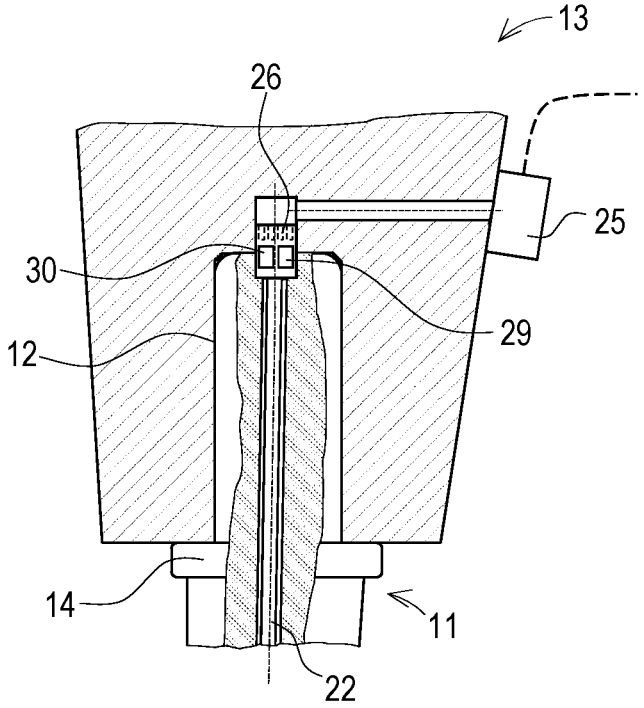
FIG. 5 a tamping tine in a tine mount

In the installed state of the tamping tine 11, the plug contacts 31 are connected to contacts of the tine mount 12 (FIG. 5). This plug connection 26 is arranged protected in the tine mount 12 and connects the sensor 23 to the evaluation device 25 fastened to the tamping tool 13. A connection to the machine control 7 takes place via a cable or via a radio interface.

The direct recording of mechanical forces, vibrations and optionally the temperature in the tamping tines 11 enables a continuous condition monitoring. This concerns initially the condition of the treated ballast bed 10. From this, adjusted control parameters can be derived in order to adapt the tamping procedure to the respective ballast bed state. This takes place automatically in the machine control 7 on the basis of all sensor data and leads to an optimized controlling of the unit drives.

Beside the condition recording of the ballast bed 10, the sensors 23 serve for documenting the individual tamping procedures. During this, it is useful if ranges for the individual measuring values are prescribed in order to recognize early any undesired deviations. In this manner, operating errors and progressive wear signs can be determined (condition monitoring). An evaluation of the documentation data enables a proactive maintenance of the wear parts, particularly the tamping tines 11 (predictive maintenance).

The invention claimed is:

1. A tamping tine for a tamping machine for tamping a track comprising:

a tine shaft which has at an upper end, a retaining portion for fastening in a tine mount, a tine plate;

wherein the tine shaft merges at a lower end into the tine plate, a tamping tine; and a sensor having a sensitive element which is arranged in a recess of the tine shaft, and that the tamping tine includes a coupling element for transmission of a sensor signal;

wherein the recess is formed as a longitudinal bore in a core section of the tine shaft.

2. The tamping tine according to claim 1, wherein the tamping tine includes electronics of the sensor.

3. The tamping tine according to claim 1, wherein the sensitive element is designed for recording several measuring values occurring in the tamping tine.

4. The tamping tine according to claim 1, wherein the coupling element is an element of a detachable plug connection.

5. The tamping tine according to claim 1, wherein the tamping tine includes an electronic component, a Trusted Platform Module, for marking the tamping tine.

6. The tamping tine according to claim 1, wherein the sensitive element is a strain element glued into the recess.

7. The tamping tine according to claim 1, wherein the sensitive element is a fibre optic cable with a fibre Bragg grating.

8. The tamping tine according to claim 7, wherein the fibre optic cable protrudes from the recess of the tine shaft, and that the protruding portion of the fibre optic cable is sheathed by a flexible protective cover.

9. A tamping machine for tamping a track, wherein oppositely positioned tamping tools are supported—actuatable with a vibration and squeezable towards one another—on a vertically adjustable tool carrier, wherein the respective tamping tool includes a tine mount in which a tamping tine according to claim 1 is fastened, and that an evaluation device is coupled to the sensor of the respective tamping tine.

10. The tamping machine according to claim 1, wherein the evaluation device is connected by means of a plug connection to the respective sensor, and that the respective plug connection is arranged at the tool carrier.

11. A method for operating a tamping machine according to claim 9, wherein a measuring value occurring in the respective tamping tine is recorded during a tamping operation by means of the associated sensor and registered by means of the evaluation device.

12. The method according to claim 2, wherein a calibration procedure is carried out for each sensor prior to a tamping operation in order to determine calibration values.

13. The method according to claim 11 wherein, prior to a tamping operation, a readout process is started for each tamping tine, and that—in the case of a missing or wrong electronic component for marking the respective tamping tine the tamping operation is blocked.

14. The method according to claim 11, wherein an exchange of a tamping tine is registered by means of the evaluation device.

15. A tamping tine for a tamping machine for tamping a track comprising:

a tine shaft which has at an upper end, a retaining portion for fastening in a tine mount, a tine plate;

wherein the tine shaft merges at its lower end into a tine plate, a tamping tine; and a sensor having a sensitive element which is arranged in a recess of the tine shaft, and that the tamping tine includes a coupling element for transmission of a sensor signal;

wherein the sensitive element is a fibre optic cable with a fibre Bragg grating; and wherein the fibre optic cable protrudes from the recess of the tine shaft, and that the protruding portion of the fibre optic cable is sheathed by a flexible protective cover.

* * * * *